US008550122B2

(12) United States Patent
Derry et al.

(10) Patent No.: US 8,550,122 B2
(45) Date of Patent: Oct. 8, 2013

(54) EXHAUST FINISHER RETENTION OPERATION

(75) Inventors: Martin Derry, Livonia, MI (US); Mozaffar Roshanfar, Smyrna, TN (US)

(73) Assignee: Nissan North America, Inc., Franklin, TN (US)

( * ) Notice: Subject to any disclaimer, the term of this patent is extended or adjusted under 35 U.S.C. 154(b) by 944 days.

(21) Appl. No.: 12/392,340

(22) Filed: Feb. 25, 2009

(65) Prior Publication Data

US 2010/0212767 A1 Aug. 26, 2010

(51) Int. Cl.
*F16L 9/02* (2006.01)

(52) U.S. Cl.
USPC ..... 138/108; 138/109; 138/110; 138/113; 138/114; 138/148; 181/227; 181/247; 181/248; 181/249

(58) Field of Classification Search
USPC ..... 138/108, 113, 114, 109, 110, 148; 181/227, 247, 248, 249
See application file for complete search history.

(56) References Cited

U.S. PATENT DOCUMENTS

| | | | | |
|---|---|---|---|---|
| 3,329,237 | A * | 7/1967 | Straw | 181/249 |
| 3,561,562 | A * | 2/1971 | Ignoffo | 181/247 |
| 3,752,260 | A * | 8/1973 | Heath | 181/228 |
| 4,356,885 | A * | 11/1982 | Dello | 181/227 |
| 4,589,515 | A * | 5/1986 | Omura | 181/227 |
| 5,145,215 | A * | 9/1992 | Udell | 285/49 |
| 5,340,165 | A * | 8/1994 | Sheppard | 285/226 |
| 5,907,134 | A * | 5/1999 | Nording et al. | 181/228 |
| 6,006,859 | A | 12/1999 | Hussaini | |
| 6,419,280 | B2 * | 7/2002 | Uegane et al. | 285/300 |
| 6,595,318 | B2 * | 7/2003 | Ebinger et al. | 181/227 |
| 6,910,506 | B2 * | 6/2005 | Gabriel et al. | 138/114 |
| 7,007,720 | B1 * | 3/2006 | Chase et al. | 138/110 |
| 2002/0153196 | A1 * | 10/2002 | Dooley | 181/228 |
| 2003/0136607 | A1 * | 7/2003 | Kawamata et al. | 181/231 |

* cited by examiner

*Primary Examiner* — James Hook
(74) *Attorney, Agent, or Firm* — Young Basile Hanlon & MacFarlane P.C.

(57) ABSTRACT

An exhaust system for a vehicle features a pipe finisher including an inner sleeve. The inner sleeve has a reduced diameter portion spaced upstream from a downstream end of the inner sleeve. An exhaust pipe disposed in the inner sleeve, the exhaust pipe including a radially outward extending projection downstream of the reduced diameter portion of the inner sleeve.

11 Claims, 5 Drawing Sheets

EXHAUST FINISHER RETENTION OPERATION

FIELD OF THE INVENTION

The present invention pertains to an exhaust system for a vehicle, and more particularly for an attachment between an exhaust pipe and a pipe finisher.

BACKGROUND

Vehicles typically have exhaust systems. For example, an exhaust system for a vehicle can include a series of conduits for transferring exhaust gases from an engine to an ambient environment surrounding the vehicle. The exhaust system can include a manifold coupled to the engine. Conduits extending from the manifold can transfer exhaust gas through various components, such as a catalytic converter for removing pollutants from the exhaust gas and/or a muffler for muting the sound of exhaust gas. At least one tailpipe or exhaust pipe extends downstream from the furthest downstream exhaust system component, typically the muffler, and exhaust gas is released through an outlet at an end of the exhaust pipe to the ambient environment.

An exhaust pipe finisher (also referred to as an exhaust pipe tip) can be placed over a downstream end of the exhaust pipe to enhance the appearance of the exhaust system and to reduce the likelihood of rust forming on the end of the exhaust pipe. The pipe finisher can be welded to the exhaust pipe, or the pipe finisher can be attached to the exhaust pipe using a snap-fit connection.

SUMMARY

Both welding a pipe finisher to an exhaust pipe and using a snap-fit connection to attach the pipe finisher to the exhaust pipe require expensive tooling and a high cost per part. Examples of an attachment between an exhaust pipe and a pipe finisher as described herein can each have a reduced cost compared to welding or using a snap-fit connection. For example, at least one example of an attachment between an exhaust pipe and a pipe finisher as described herein can be performed with only minor tooling costs and without any addition part costs.

In one example of an exhaust system for a vehicle, a pipe finisher includes an inner sleeve, and the inner sleeve has a reduced diameter portion spaced upstream from a downstream end of the inner sleeve. An exhaust pipe is disposed in the inner sleeve, and the exhaust pipe includes a radially outward extending projection downstream of the reduced diameter portion of the inner sleeve.

In another example, a vehicle includes an exhaust system. The exhaust system includes an exhaust pipe having a downstream end defining an outlet in communication with an ambient environment about the vehicle. The exhaust pipe also has a radially outward extending projection upstream of the outlet. A pipe finisher around the downstream end of the exhaust pipe includes a reduced diameter portion upstream of the radially outward extending projection of the exhaust pipe. The reduced diameter portion of the pipe finisher has a smaller diameter than a diameter of a portion of the exhaust pipe including the radially outward extending projection.

Examples of a method of engaging a pipe finisher including an inner sleeve having a reduced diameter portion spaced upstream from a downstream end of the inner sleeve with an exhaust pipe are also described herein. In one example, the method includes sliding the pipe finisher onto the exhaust pipe such that an outlet of the exhaust pipe is further downstream than the reduced diameter portion of the inner sleeve, and the method includes forming a radially outward extending projection in the exhaust pipe downstream of the reduced diameter portion of the inner sleeve.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
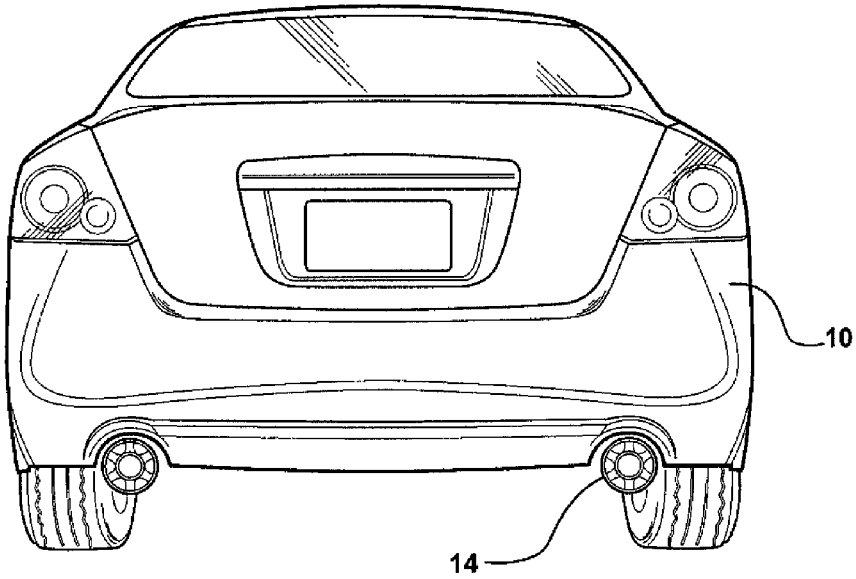
FIG. 1 is a rear view of a vehicle including an exhaust system having two exhaust pipes, each including a pipe finisher.

As shown in a FIG. 1, a vehicle 10 can include an exhaust system concluding with one or more pipe finishers 14, with the number of pipe finishers 14 depending on the number of exhaust pipe outlets the vehicle 10 includes. The exhaust system can include, for example, a series of conduits extending from an engine of the vehicle 10 to an ambient environment external the vehicle 10, and components such as a catalytic converter and/or a muffler can be included in the exhaust system. While the pipe finishers 14 are shown on the rear end of the vehicle 10, one or more of the pipe finishers 14 can alternatively extend laterally, such as if the vehicle 10 includes a side exit exhaust system.

Figure 2:
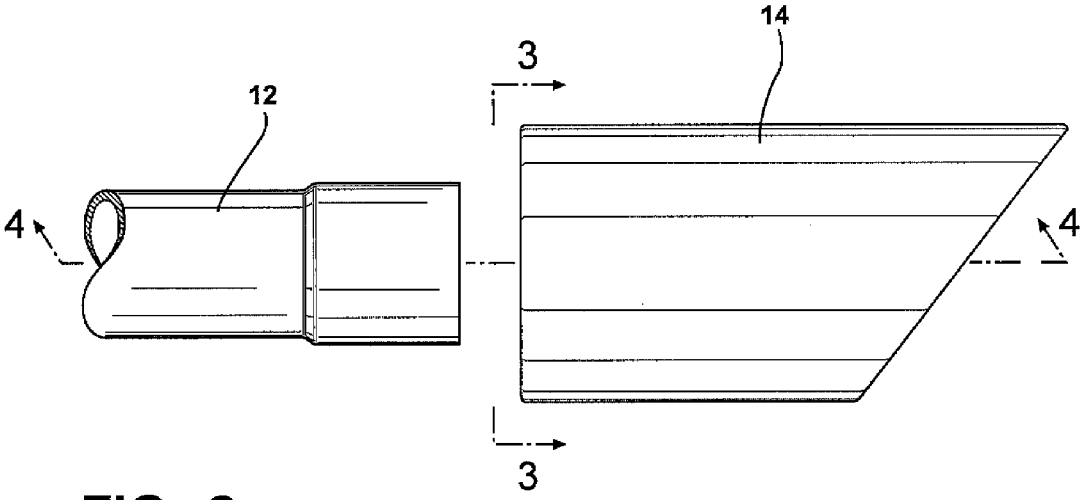
FIG. 2 is an exploded side view of a fragmented exhaust pipe and a pipe finisher.

Referring now to FIG. 2, an exhaust pipe 12 can extend from the furthest downstream component in the exhaust system, such as a muffler. (The terms "upstream" and "downstream" as used herein are relative to the direction in which exhaust gases flow through the exhaust pipe 12 and the pipe finisher 14, with the upstream direction illustrated by arrow 11*a* in FIG. 4 and the downstream direction illustrated by arrow 11*b* in FIG. 4.) One of the pipe finishers 14 can be placed over the exhaust pipe 12 to improve the appearance of the exhaust pipe 12 and to reduce the likelihood of the exhaust pipe 12 developing rust, among other benefits.

Figure 3:
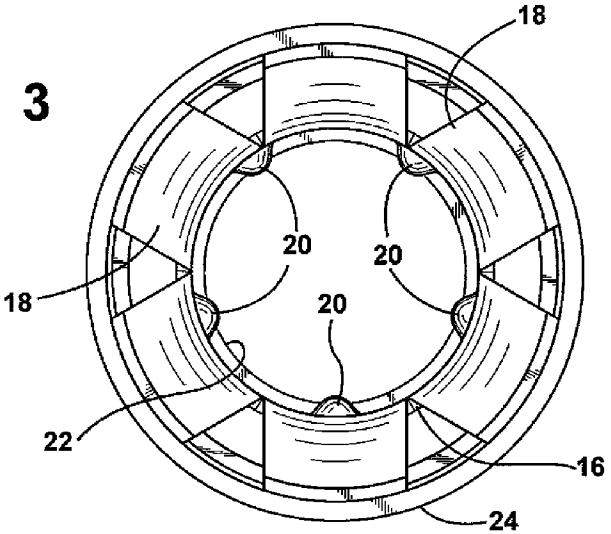
FIG. 3 is an end view of the pipe finisher of FIG. 2 from the vantage of line 3-3.
Figure 4:
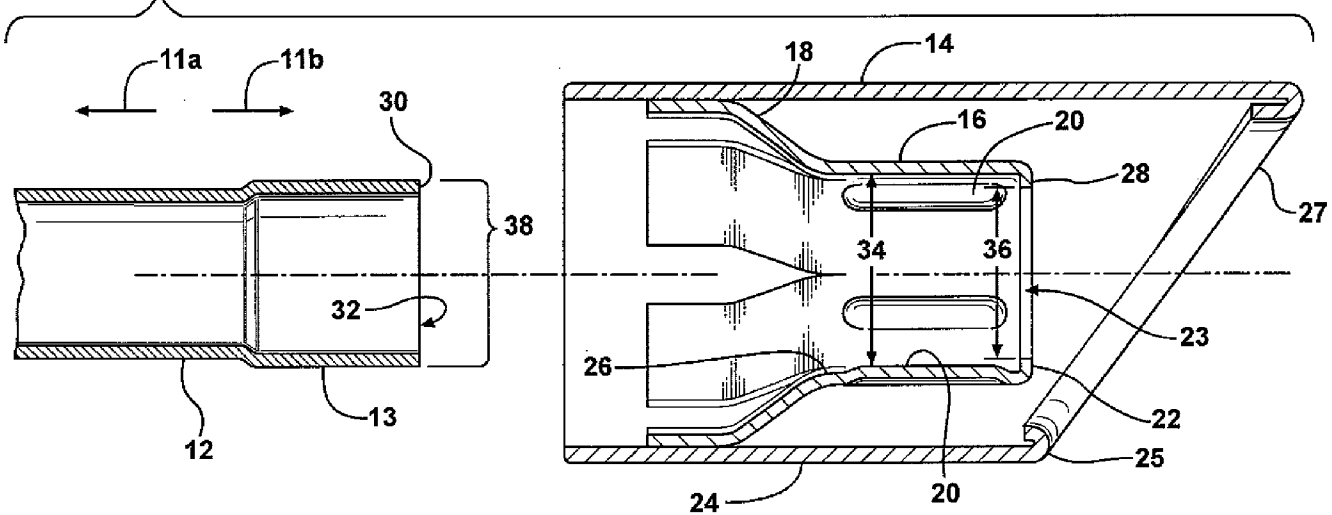
FIG. 4 is a cross-section of FIG. 2 taken along line 4-4.

As shown in FIGS. 3 and 4, the pipe finisher 14 can include an inner sleeve 16 and an outer sleeve 24. The inner sleeve 16 can be sized to receive the exhaust pipe 12, as is described in greater detail below in relation to FIG. 5. The inner sleeve 16 can include multiple circumferentially spaced tabs 18 extending upstream and radially outward from an upstream end 26 of the inner sleeve 16. As a result, the tabs 18 can be angled outward from the longitudinal axis of the inner sleeve 16. The tabs 18 can have distal ends fixed to the inside of the outer sleeve 24, such as by welding the tabs 18 to the interior of the outer sleeve 24 or by bolting the tabs 18 to the outer sleeve 24. By fixing the tabs 18 to the outer sleeve 24, the inner sleeve 16 can be suspended in a concentric position relative to the outer sleeve 24. The tabs 18 can be formed integrally with the inner sleeve 16, such as by creating circumferentially spaced, longitudinally extending cuts in a hollow piece of cylindrical material. The cuts can extend a portion of the length of the piece of cylindrical material, and the cut portions of the piece of material can be bent radially outward to form the tabs 18, while the uncut portion of the piece of material can be used to form the inner sleeve 16 as is described in greater detail below. Additional or alternative tabs 18 can also be included, such as tabs 18 (not shown) that extend downstream from a downstream end 28 of the inner sleeve 16 and are fixed to the outer sleeve 24.

Still referring to FIGS. 3 and 4, the inner sleeve 16 can include a first reduced diameter portion, which in example illustrated in FIGS. 3 and 4 includes multiple circumferentially spaced ribs 20. The ribs 20 can be spaced downstream from the upstream end 26 of the inner sleeve 16. The ribs 20 can extend axially relative to the inner sleeve 16, and the ribs 20 can also protrude toward the radial center of the inner sleeve 16. The ribs 20 can be formed by, for example, creating radially inward indentations into the sleeve 16. The geometry of the ribs 20 is discussed in greater detail below in relation to FIG. 5. While five ribs 20 are shown in FIG. 4, an alternative number of ribs 20 can be included. Also, instead of the reduced diameter portion of the inner sleeve 16 including the ribs 20, an alternative reduced diameter portion can include an annular ring fixed to the interior of the inner sleeve 16 or another structure extending radially inward relative to the inner sleeve 16.

Also as shown in FIGS. 3 and 4, the downstream end 28 of the inner sleeve 16 can include a radially inward extending lip 22. The lip 22 can be formed by bending an uncut end of the piece of material discussed above in relation to the formation of the tabs 18 radially inward. The lip 22 can also define an aperture 23, and the geometry of the lip 22 and aperture 23 are discussed below in greater detail in relation to FIG. 5.

Still referring to FIGS. 3 and 4, the outer sleeve 24 can have a cylindrical shape with a greater diameter than the inner sleeve 16. A downstream end 27 of the outer sleeve 24 can be cut at an angle in order to, for example, improve the aesthetics of the pipe finisher 14, and the downstream end 27 of the outer sleeve 24 can also include a curl 25 to avoid a sharp edge. Additionally, the exterior surface of the outer sleeve 24 can be decorative, such as by forming the outer sleeve 24 of stainless steel and shining the outer sleeve 24, or by chrome plating the exterior of the outer sleeve 24.

As shown in FIG. 4, the exhaust pipe 12 can have a downstream end 30 defining an outlet 32. The exhaust pipe 12 can also include a flared downstream section 13 having a larger diameter 38 than an upstream portion of the exhaust pipe 12. The exhaust pipe 12 can be in communication with upstream exhaust system components for receiving exhaust gas generated by an engine of the vehicle 10, and the exhaust gas can flow downstream through the exhaust pipe 12, through the outlet 32 in the exhaust pipe 12, through the aperture 23 in the pipe finisher 14, and into the ambient environment.

Figure 5:
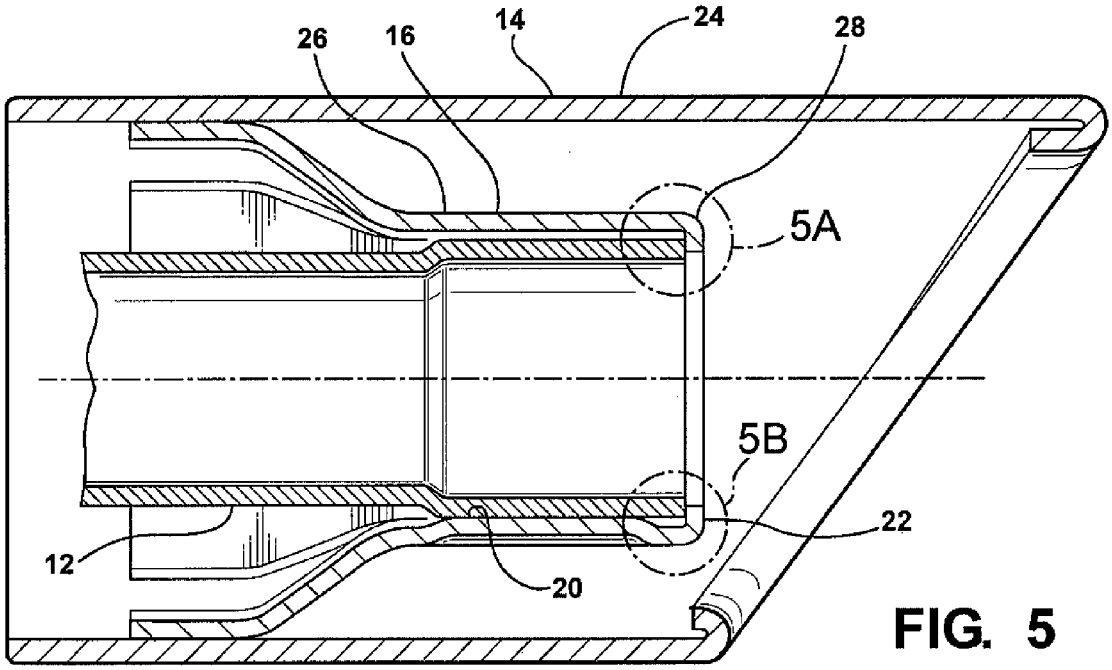
FIG. 5 is a cross-section taken from the same perspective as FIG. 4 with the exhaust pipe disposed in an inner sleeve of the pipe finisher.
Figure 5A:
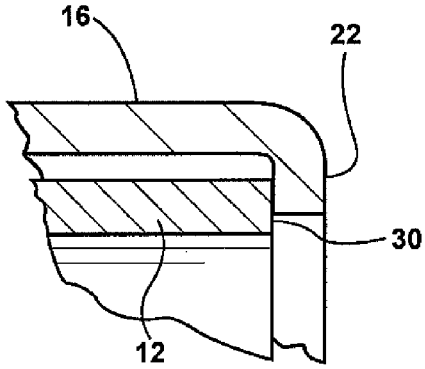
FIGS. 5A and 5B are enlarged views of areas 5A and 5B, respectively, in FIG. 5.
Figure 5B:
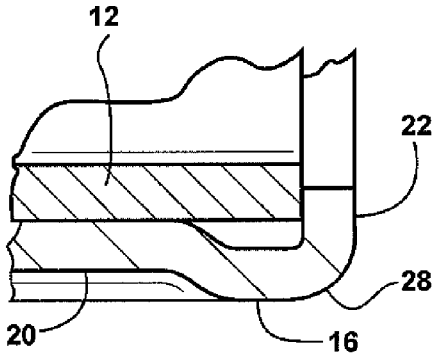

The pipe finisher 14 can be installed on the exhaust pipe 12 by sliding the pipe finisher 14 over the downstream end 30 of the exhaust pipe 12 to the position shown in FIG. 5, with the exhaust pipe 12 entering the inner sleeve 16 through the upstream end 26 of the inner sleeve 16. An inner diameter 34 of the reduced diameter portion of the inner sleeve 16, here the inner diameter 34 of a portion of the inner sleeve 16 including at least one of the ribs 20, can be slightly less than the diameter 38 of the exhaust pipe 12. Sliding the pipe finisher 14 onto the exhaust pipe 12 can cause the exhaust pipe 12 to contact the ribs 20 and, when pressure is applied to the pipe finisher 14 in the downstream direction, to bias the ribs 20 slightly radially outward. As a result of the exhaust pipe 12 biasing the ribs 20 slightly radially outward, the pipe finisher 14 can be slid upstream onto the exhaust pipe 12. Further, as a result of being biasing radially outward, the ribs 20 can produce a radially inward force acting on the exhaust pipe 12. The radially inward force produced by the ribs 20 can increase the amount of friction between the exhaust pipe 12 and the pipe finisher 14, thereby increasing the force required to move the pipe finisher 14 downstream off of the exhaust pipe 12. This friction force is not necessary, and therefore the inner sleeve 16 and/or ribs 20 can have a different geometry. For example, the inner diameter 34 of the reduced diameter portion of the inner sleeve 16 can be equal to or greater than the diameter 38 of the exhaust pipe 12, in which case the pipe finisher 14 can be slid onto the exhaust pipe 12 with a lesser amount of force.

Also, a diameter 36 of the aperture 23 defined by the lip 22 can be less than the diameter 38 of the exhaust pipe 12, thereby preventing the exhaust pipe 12 from sliding past the lip 22. As a result, engagement between the downstream end 30 of the exhaust pipe 12 and the lip 22 of the inner sleeve 16 can prevent the pipe finisher 14 from being slid too far onto the exhaust pipe 12. However, the downstream end 30 of the exhaust pipe 12 need not necessarily engage the lip 22 when the pipe finisher 14 is slid onto the exhaust pipe 12, though the pipe finisher 14 should be slid sufficiently far onto the exhaust pipe 12 that the downstream end 30 of the exhaust pipe 12 is positioned downstream of the reduced diameter portion (the ribs 20 as shown in FIGS. 3-8) as shown in FIG. 5.

Figure 6:
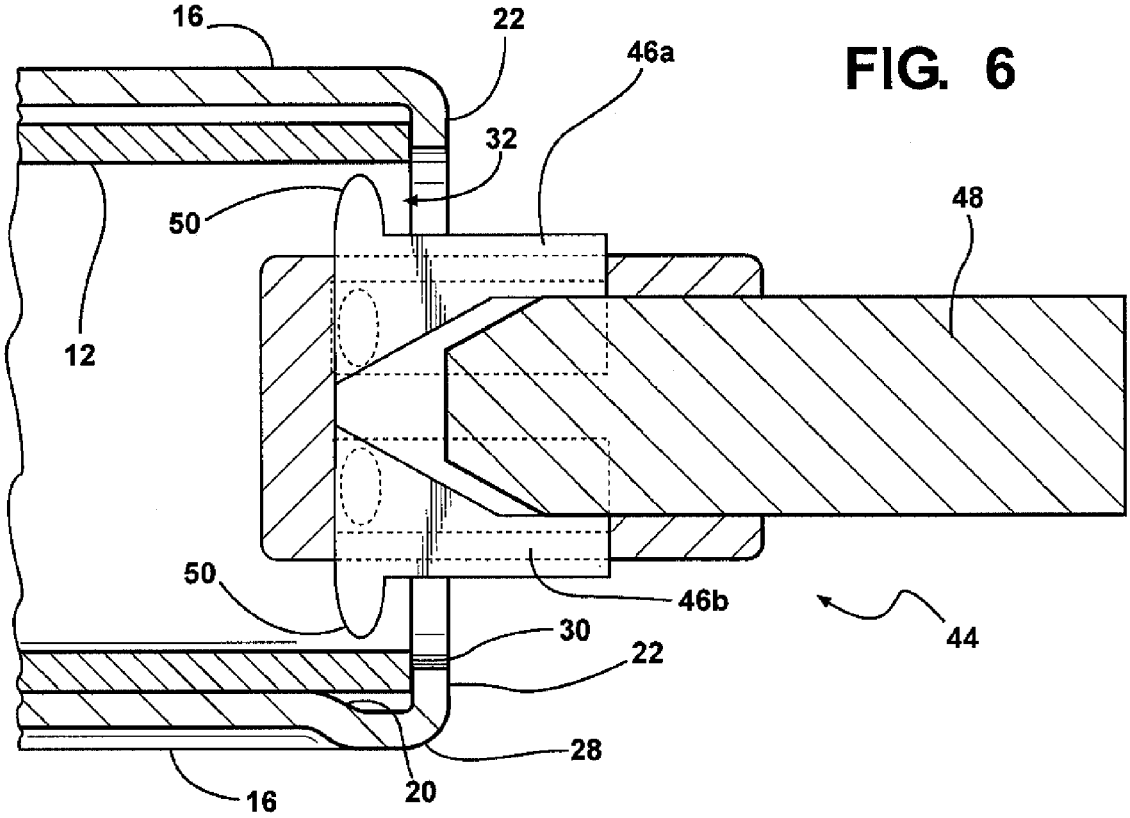
FIG. 6 is the same view as FIG. 5 including a tool inserted into an outlet of the exhaust pipe.

Referring now to FIG. 6, with the exhaust pipe 12 and pipe finisher 14 in the same positions as described above in reference to FIG. 5, a tool 44 can be moved upstream into the outlet 32 of the exhaust pipe 12. The tool 44 can include an expandable end 46 actuated by an actuator 48. The downstream portion of the expandable end 46 as shown in FIG. 6 can have a V-shaped profile, while the upstream portion of the actuator 48 can have a corresponding V-shaped profile. Additionally, the upstream portion of the expandable end 46 can include multiple circumferentially spaced and radially extending teeth 50, with two teeth 50 visible in FIG. 6. The expandable end 46 can be positioned within exhaust pipe 12 such that the teeth 50 are radially aligned with the portion of the exhaust pipe 12 downstream of the reduced diameter portion of the inner sleeve 16 (the ribs 20 in the present example) and upstream of the lip 22.

Figure 7:
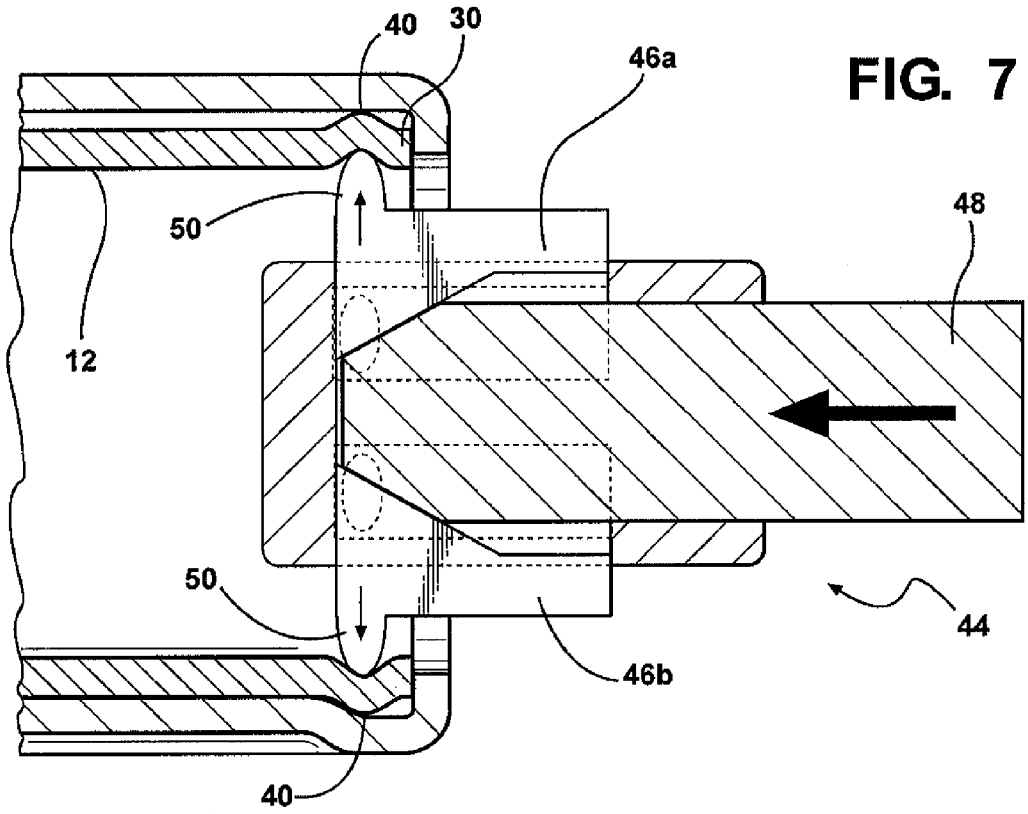
FIG. 7 is the same view as FIG. 5 with the tool of FIG. 6 engaged with an inner diameter of the exhaust pipe.

Referring now to FIG. 7, the actuator 48 can be moved upstream relative to the expandable end 46 to engage the respective V-shaped portions of the actuator 48 and expandable end 46. Once the actuator 48 contacts the expandable end 46, further upstream movement of the actuator 48 can drive two portions of the expandable end **46*a* and 46*b* radially apart, thereby moving the tooth 50 of each portion 46*a* and 46*b* radially outward, while the two portions of the expandable end 46*a* and 46*b* remain at substantially the same position axially. The teeth 50 contact the portion of the exhaust pipe 12 between the ribs 20 and lip 22 of the inner sleeve 16, and the teeth 50 create radially outward extending indentations 40 in the inner sleeve 16**.

Figure 8:
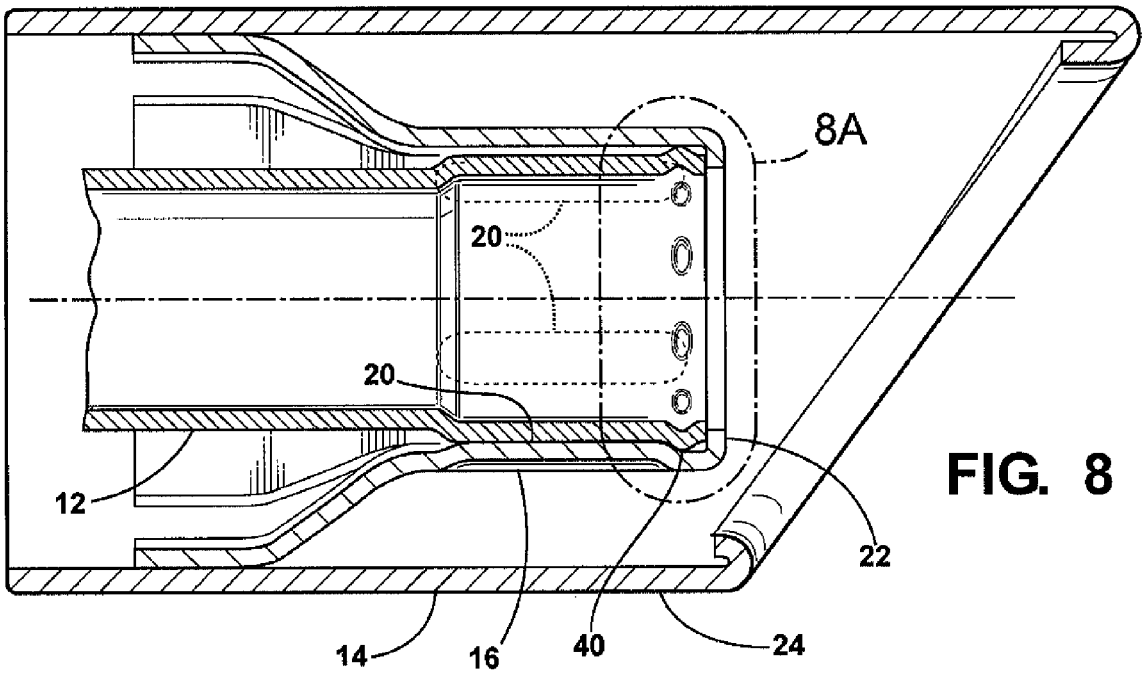
FIG. 8 is the same view as FIG. 5 once the tool of FIGS. 6 and 7 is removed.
Figure 8A:
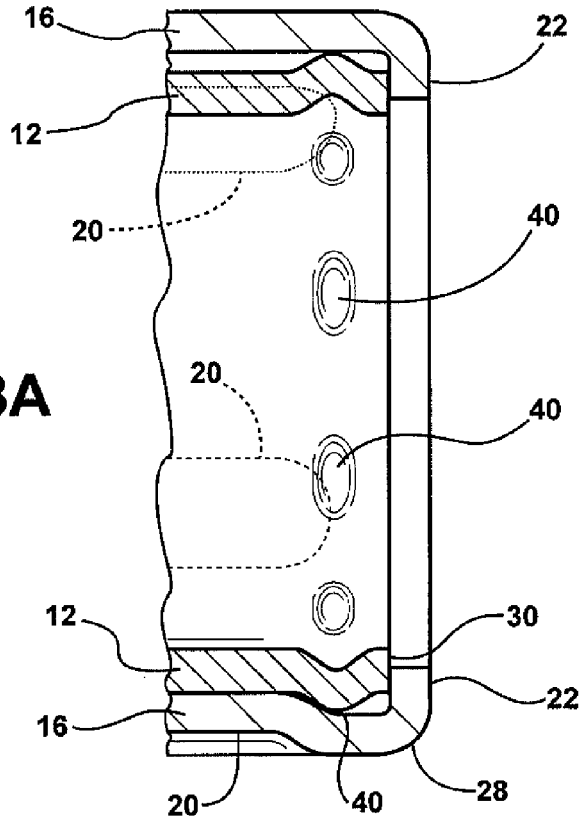
FIG. 8A is an enlarged view of area 8A in FIG. 8.

As shown in FIG. 8, the indentations 40 can be located axially between the ribs 20 and the lip 22. Additionally, at least one of the indentations 40 can be aligned circumferentially with at least one of the ribs 20. Also, while two teeth 50 are shown in FIGS. 6 and 7, the expandable end 46 can include multiple circumferentially spaced teeth 50 as mentioned above, and the indentations 40 formed by teeth 50 that are not visible in FIGS. 6 and 7 can be seen in FIG. 8. As a result of the formation of the indentations 40, if the pipe finisher 14 is urged downstream, at least one of the ribs 20 will contact at least one of the indentations 40, thereby hindering downstream movement of the pipe finisher 40. A sufficiently large amount of force can be required to move the ribs 20 of the pipe finisher 14 downstream: past the indentations 40 such that the pipe finisher 14 is effectively attached to the exhaust pipe 12.

For example, prior to forming the indentations 40, tests of one example of the exhaust pipe 12 and pipe finisher 14 have shown that friction between the ribs 20 of the inner sleeve 16 and the exhaust pipe 12 can require 91.92 pounds of force to remove the pipe finisher 14 from the exhaust pipe 12. However, after forming the indentations 40, the amount of force required to remove the pipe finisher 14 from the exhaust pipe 12 is increased to 1241.06 pounds to initially break the indentations 40 from the inner sleeve 16 and 1195.59 pounds to remove the pipe finisher 14 from the exhaust pipe 12 once the indentations 40 are broken from the inner sleeve 16 when the indentations 40 do contact the ribs 20, which is over a 1300% increase in the amount of force required to remove the pipe finisher 14 from the exhaust pipe 12 compared to prior the formation of the indentations 40.

The exhaust pipes 12 and pipe finishers 14 described above are merely examples; other exhaust pipes 12 and pipe finishers 14 can also incorporate other features described here, such as the indentations 40 and the method of forming the indentations 40. For example, while the pipe finisher 14 is shown as including the inner sleeve 16 and outer sleeve 24, the pipe finisher 14 can have an alternative structure defining an inner sleeve 16. In one example of an alternative structure, the inner sleeve 16 can be formed by creating a bore in a solid stock of material, and the exterior of the stock of material can be shaped to form the exterior of the pipe finisher 14. In another example of how the exhaust pipe 12 and pipe finisher 14 can have different structures than described above, instead of multiple circumferentially spaced intentions 40, the exhaust pipe 12 can include a circular radially outward protruding ridge extending around an entire circumference of the exhaust pipe 12. Such a ridge can be formed by, as an example, forming one set of indentations 40, rotating the tool 44, and forming a second set of indentations 40 such that the two sets of indentations 40 together form the circular ridge. As yet another example of how the exhaust pipe 12 and pipe finisher 14 can have different structures than described above, the teeth 50 can be sufficiently large that the indentations 40 extend radially outward into the inner sleeve 16. In still yet another example of how the exhaust pipe 12 and pipe finisher 14 can have different structures that described above, the indentations 40 need not be circumferentially aligned with the ribs 20; the strength of the connection between the exhaust pipe 12 and the pipe finisher 14 can be greatly increased even if the indentations 40 and ribs 20 are not circumferentially aligned. A test of one example of the exhaust pipe 12 and the pipe finisher 14 in which the indentations 40 formed in the exhaust pipe 12 do not align with the ribs 20 in the pipe finisher 12 showed that 967.87 pounds were required to remove the pipe finisher 14 from the exhaust pipe 12 once the indentations 40 are broken from the inner sleeve 16. As a final example in which the method for forming the indentations 40 can vary from as described above, the indentations 40 can be formed in a different manner than actuating the tool 44 to drive the expandable end 46 radially outward, such as by rotating engaging a tool with inner circumference of the exhaust pipe 12 and rotating the tool to form an arc-shaped indentation.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed:

1. An exhaust system for a vehicle comprising:

a pipe finisher including an inner sleeve having a first inner diameter and a downstream end, wherein the inner sleeve has inwardly extending ribs spaced around a circumference of the inner sleeve, the inner sleeve having a second inner diameter at the ribs less than the first inner diameter; and an exhaust pipe disposed in the inner sleeve, the exhaust pipe including a radially outward extending projection positioned downstream of the ribs of the inner sleeve.

2. The exhaust system of claim 1, wherein an outer diameter of the exhaust pipe including the radially outward extending projection is greater than the second diameter of the inner sleeve.

3. The exhaust system of claim 2, wherein a portion of the exhaust pipe upstream of the radially outward extending projection has an outer diameter less than or equal to the second diameter of the inner sleeve.

4. The exhaust system of claim 2, wherein a portion of the exhaust pipe upstream of the radially outward extending projection has a diameter greater than the second diameter of the inner sleeve, and wherein the ribs of the inner sleeve are operable in response to insertion of the exhaust pipe into the inner sleeve to be biased radially outward.

5. The exhaust system of claim 2, wherein the second diameter of the inner sleeve is a first reduced diameter portion and the downstream end of the inner sleeve is a second reduced inner diameter portion, and wherein the radially outward extending projection of the exhaust pipe is disposed axially between the first and second reduced inner diameter portions of the inner sleeve.

6. The exhaust system of claim 1, wherein at least a portion of the radially outward extending projection is circumferentially aligned with at least one rib of the inner sleeve.

7. The exhaust system of claim 1, wherein the downstream end of the inner sleeve includes a lip extending radially inward and defining an aperture, and wherein a downstream end of the exhaust pipe adjacent the lip has a greater outer diameter than a diameter of the aperture.

8. The exhaust system of claim 7, wherein the radially outward extending projection of the exhaust pipe is axially spaced between the second inner diameter of the inner sleeve and the lip of the inner sleeve.

9. The exhaust system of claim 1, wherein the radially outward extending projection of the exhaust pipe includes a plurality of circumferentially spaced radially outward extending projections.

10. A vehicle comprising:

an exhaust system including an exhaust pipe having a downstream end defining an outlet in communication with an ambient environment about the vehicle and having a radially outward extending projection upstream of the outlet; and a pipe finisher around the downstream end of the exhaust pipe, the pipe finisher including:

an inner sleeve having a first inner diameter and a downstream end, wherein the inner sleeve has inwardly extending ribs spaced around a circumference of the inner sleeve, the inner sleeve having a second inner diameter at the ribs less than the first inner diameter, where the radially outward extending projection of the exhaust pipe is located downstream of the ribs of the inner sleeve.

11. The vehicle of claim 10, wherein the radially outward extending projection of the exhaust pipe includes a plurality of circumferentially spaced radially outward extending projections.

* * * * *